US005535451A

United States Patent [19]

Tassone et al.

[11] Patent Number: 5,535,451

[45] Date of Patent: Jul. 16, 1996

[54] PANTS GARMENT WITH BUTTOCKS ENHANCEMENT

[75] Inventors: Clare M. Tassone, Seaford, N.Y.; Miles Rubin, El Paso, Tex.

[73] Assignee: Sun Apparel Inc., New York, N.Y.

[21] Appl. No.: 430,202

[22] Filed: Apr. 27, 1995

[51] Int. Cl.[6] ..... A41D 1/06

[52] U.S. Cl. ..... 2/227; 2/69

[58] Field of Search ..... 2/69, 79, 227, 2/228, 238, 243.1

[56] References Cited

U.S. PATENT DOCUMENTS

| | | | |
|---|---|---|---|
| 3,143,741 | 8/1964 | Tyroler | 2/227 |
| 3,323,140 | 6/1967 | Morris | 2/227 |
| 3,996,622 | 12/1976 | Cooke | 2/227 |
| 4,850,056 | 7/1989 | Gardner et al. | 2/227 |
| 4,875,240 | 10/1989 | Barrett | 2/227 |
| 4,989,272 | 2/1991 | Wagner | 2/227 |

*Primary Examiner*—C. D. Crowder
*Assistant Examiner*—Gloria Hale
*Attorney, Agent, or Firm*—Kane, Dalsimer, Sullivan, Kurucz, Levy, Eisele and Richard

[57] ABSTRACT

A pants garment of stretch material is formed of right and left rear panels and right and left front panels. Each of the panels includes a rise portion and a leg portion. The rear rise portions are connected from the crotch of the garment to the waist along an accentuated, contoured rounded line. The garment legs, measured from the crotch to the outseams is narrowed to engage the thigh a wearer to urge the buttocks of the wearer upwardly to thereby fill out and conform to said rear curved line and to prevent the buttocks from spreading vertically.

9 Claims, 4 Drawing Sheets

PANTS GARMENT WITH BUTTOCKS ENHANCEMENT

BACKGROUND OF THE INVENTION

The present invention relates to a pants garment and in particular to a garment designed to shape and boost the buttocks of the wearer.

Women have long worn foundation garments to try to shape and flatter their figures. Such foundation garments, in addition to being uncomfortable, cannot readily be worn under the newer stretch fabrics because the fabrics tend to follow the foundation garment lines and hence reveal the under garments.

SUMMARY OF THE INVENTION

In view of the above, it is a principle object of the present invention to provide an improved pants garment having integral figure enhancement.

In particular the garment of the present invention is designed so as to lift and shape the buttocks of the wearer.

The above and other beneficial objects and advantages are attained in accordance with the present invention by providing a pants garment formed of right and left rear panels and right and left front panels. The rear panels are joined along a rear curved line from a crotch of the garment to a waist band and the front panels are joined along a front curved line from the crotch of the garment to the waist band. The rear curved line is accentuated so as to be more rounded than that of a conventional garment and substantially more rounded the front curve which approaches being flat. The width of the garment from the crotch to the outer seams is reduced sufficiently to engage the flesh at the thighs of the wearer to urge the buttocks upwardly to fill out and conform to the rear curved line. The rear of the garment is further provided with visual enhancements of the raised buttocks. Specifically, the width of the back yoke is reduced, the back pockets are placed close to the yoke and taper downwardly and outwardly and the tops of the pockets are disposed parallel to the yoke.

DETAILED DESCRIPTION OF THE PRESENT INVENTION

Reference is now made to the drawings and to FIG. 1 in particular wherein the garment 10A of the present invention is shown in contrast to a conventional garment 10B. As may be noted, when worn, all other things being equal, the garment of the present invention lifts and rounds the buttocks 12A of the wearer as compared with the buttocks 12B of the wearer in a conventional garment. The present construction is particularly suited for jeans although the invention is applicable to other pants and shorts.

Figure 3A:
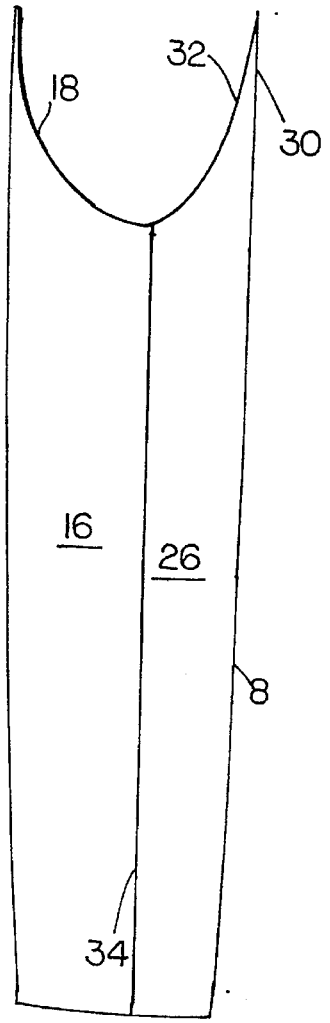
FIG. 3A is a side sectional view of the pants garment of FIG. 1A taken through the crotch of the pants.
Figure 3B:
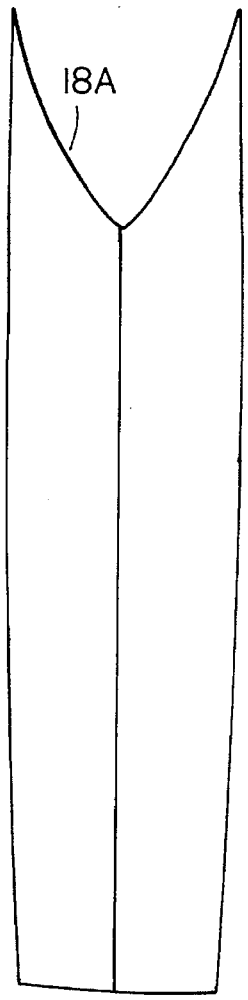
FIG. 3B PRIOR ART
FIG. 3B is a side sectional view of the pants garment of FIG. 1B taken through the crotch of the pants.
Figure 6:
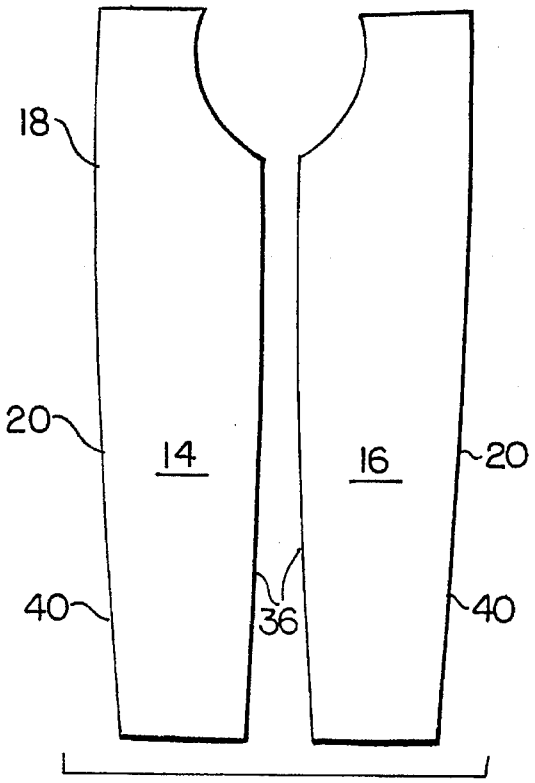
FIG. 6 is a plan view of the rear panels of the pants garment of the present invention.
Figure 7:
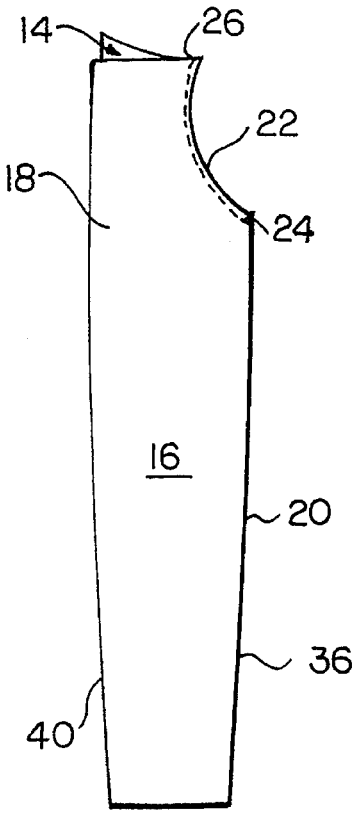
FIG. 7 shows the manner of joining the rear panels to form the rear of the pants garment of the present invention.
Figure 5:
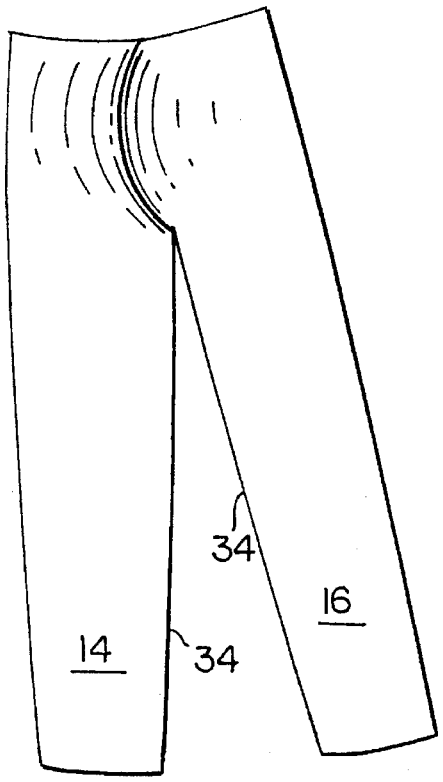
FIG. 5 is a perspective view of the rear of the pants garment of the present invention.

Referring to FIG. 6, it will be noted that the garment rear is formed of two rear panels 14 and 16, for the left and right halves of the garment, respectively. Each of the panels includes a rise portion 18 and leg portion 20. The garment rise portions are joined along a curved line 22 that extends from the crotch 24 to the garment waist 25. The front of the garment is likewise formed of right and left panels 26 each having a leg portion 28 and a rise portion 30 joined along a curved line 32. As shown in FIG. 3A, curved line 18 which defines the rear seam is much more rounded than a conventional garment rear seam. It is also more rounded than curved line 32, defining the front seam as shown in FIG. 3A.

An inseam 34 joins the inner edges 36 of the right front and rear leg portions from the crotch to the bottom of the pants leg. A comparable inseam joins the left front and rear leg portions from the crotch to the bottom of the pants leg. Likewise, outseam 38 joins the outer edges 40 of the right front and rear leg portions from the waist to the bottom of the pants leg and a comparable outseam joins the outer edges of the left front and rear leg portions.

The pants garment of the present invention is preferably formed of a stretch material such as a blend of 96% cotton and 4% elastomeric fiber such as Lycra® or Spandex® or 98% cotton and 2% elastomeric fiber. Such blends are commonly used in stretch jeans.

Figure 1A:
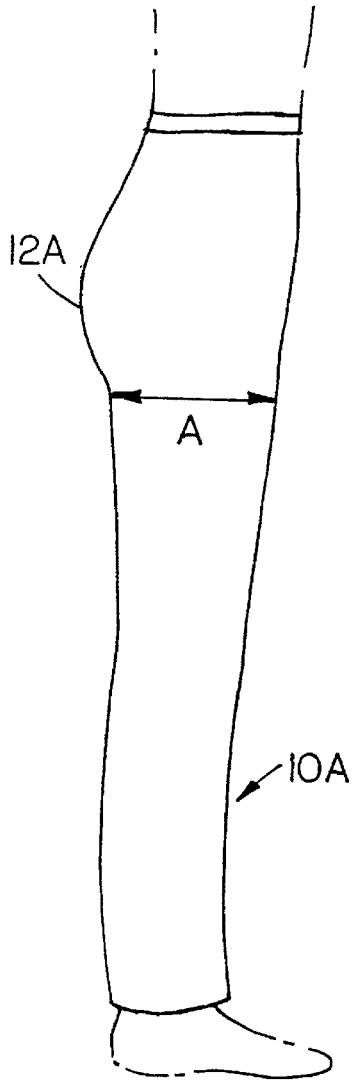
FIG. 1A is a side elevational view of the pants garment of the present invention.
Figure 1B:
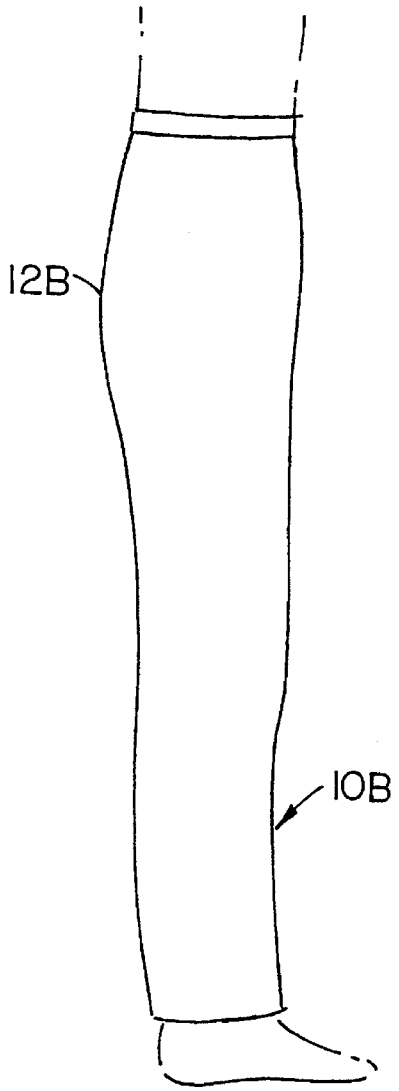
FIG 1B PRIOR ART
FIG. 1B is a side elevational view, similar to FIG. 1A, of a conventional pants garment.
Figure 2:
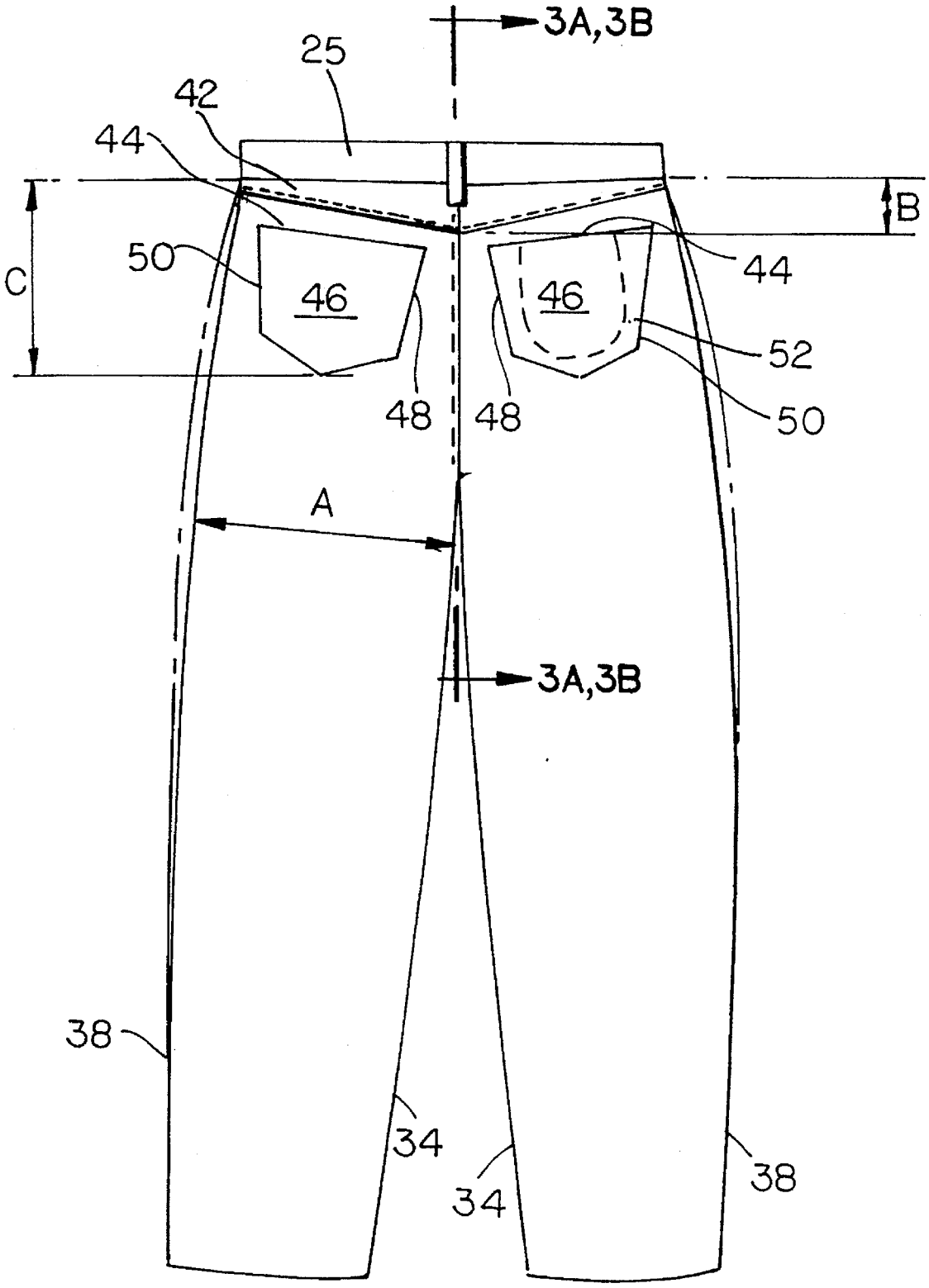
FIG. 2 is a rear view of the pants garment of the present invention.
Figure 4:
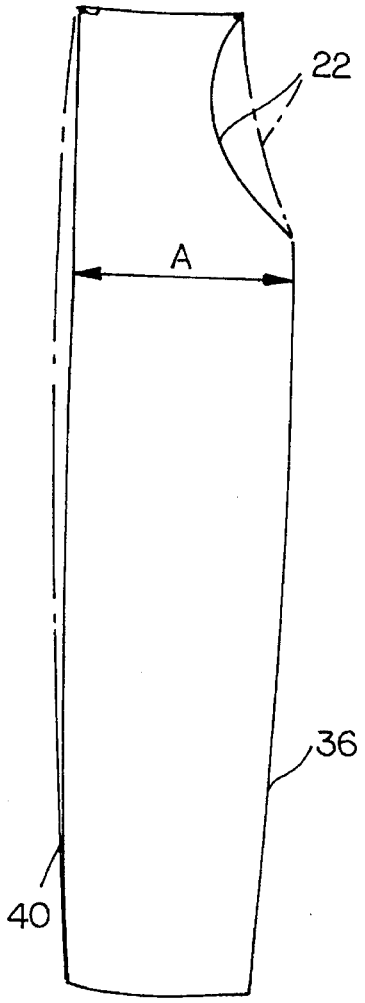
FIG. 4 is a plan view of a single rear panel of the pants garment of the present invention.

An important aspect of the present invention is that the width of each leg measured from the crotch to the outseam is narrowed. This may be seen in FIGS. 2 and 4 wherein the narrowed dimension "A" may be compared with the dotted line representation of a conventional pants leg. As shown in FIG. 1, the narrowing is such as to cause the pants leg to engage the upper thigh of the wearer. This has the effect of lifting up the buttocks of the wearer to fill in and conform to the rear curved line 22. Conversely the narrowing at the upper thigh compresses the thigh, thereby preventing the buttocks from spreading vertically into the upper thigh portion of the garment as shown in FIG. 1B. In other words, a more clearly defined boundary is created between the buttocks and thigh as shown in FIG. 1A.

Visual enhancements may be provided to the pants garment to emphasize the raised buttocks provided by the above construction. Thus, the yoke 42 of the pants garment is made relatively narrow and the top edges 44 of pockets 46 extend parallel to the yoke, rather than parallel to the waist as with a conventional garment. Further, the inside edges 48 of the pockets taper upwardly while the outside edges 50 taper downwardly. That is, the inside edges 48 separate further as the pockets extend downwardly while the outside edges 50 move toward each other. In addition, uneven stitching 52 is provided about the pockets. The stitching runs down the pockets along lines that are spaced further from the pocket side edges at the pocket top then at the pocket bottom. The above tend to draw a viewer's eye upwardly, thereby enhancing the effect of the raised buttocks provided by the above described construction.

It should be apparent that various changes may be made to the above description without departing from the scope of the present invention as set forth in the following claims. For example, while the preferred embodiment is directed at jeans, the pants garment could be shorts, clam diggers or the like.

Having thus described the invention, what is claimed is:

1. A pants garment comprising:

right and left rear panels, each of said panels having a leg portion and a rise portion, the rise portions being joined along a rear curved line from a crotch of said garment to a waist band;

right and left front panels, each of said panels having a leg portion and a rise portion, the rise portions being joined along a front curved line from the crotch of said garment to the waist band, the curvature of the rear curved line being more accentuated than the front curved line to accommodate a raised buttocks of a wearer;

each of said right leg portions being joined from the crotch downwardly along a right outseam and a right inseam to form a right pants leg and each of said left leg portions being joined from the crotch downwardly along a left outseam and a left inseam to form a left pants leg; and the dimension of each of said legs being narrowed between the crotch and the outseams whereby to engage the thigh of a wearer to urge the buttocks of the wearer upwardly to thereby fill out and conform to said rear curved line.

2. The invention in accordance with claim 1 wherein said garment is formed of a stretch material.

3. The garment in accordance with claim 2 wherein said stretch material comprises a blend of 96% cotton and 4% elastomeric fiber.

4. The garment in accordance with claim 2 wherein said stretch material comprises a blend of 98% cotton and 2% elastomeric fiber.

5. The garment in accordance with claim 1 wherein said front and rear right panel rise portions are joined along said right outseam, said front and rear left panel rise portions are joined along said left outseam and further comprising a yoke extending transversely across said right and left rear panel rises, said yoke tapering downwardly from said right and left outseams toward said rear curved line.

6. The garment in accordance with claim 4 further comprising at least one rear pocket on at least one of said rear panel rise portions, said rear pocket having a top edge substantially parallel to said yoke.

7. The garment in accordance with claim 6 comprising a rear pocket on each of said rear panel rise portions, said pockets each having an inner edge tapering downwardly and outwardly toward, the associated outseam.

8. The garment in accordance with claim 7 wherein said pockets each have an outer edge tapering downwardly and inwardly toward the associated inseam.

9. The garment in accordance with claim 8 further comprising stitching along said pocket inner and outer edges, said stitching being nonparallel to said edges, approaching said edges extending downwardly along the pockets.

* * * * *